US012590394B2

(12) United States Patent
Borlin et al.

(10) Patent No.: US 12,590,394 B2
(45) Date of Patent: Mar. 31, 2026

(54) AIR BYPASS SEAL WITH BACKER FOR IMPROVED DRYING PERFORMANCE IN A COMBINATION WASHER/DRYER

(71) Applicant: Whirlpool Corporation, Benton Harbor, MI (US)

(72) Inventors: Christopher Lee Borlin, St. Joseph, MI (US); Stephen Ostdiek, St. Joseph, MI (US); Vaclav Petracek, Svit (SK); Marcel Schmidt, Poprad (SK)

(73) Assignee: Whirlpool Corporation, Benton Harbor, MI (US)

( * ) Notice: Subject to any disclaimer, the term of this patent is extended or adjusted under 35 U.S.C. 154(b) by 824 days.

(21) Appl. No.: 17/947,671

(22) Filed: Sep. 19, 2022

(65) Prior Publication Data

US 2024/0093418 A1 Mar. 21, 2024

(51) Int. Cl.

| | |
|---|---|
| ***D06F 58/08*** | (2006.01) |
| ***D06F 25/00*** | (2006.01) |
| ***D06F 37/26*** | (2006.01) |
| ***D06F 58/22*** | (2006.01) |

(52) U.S. Cl.

CPC ..... *D06F 25/00* (2013.01); *D06F 37/263* (2013.01)

(58) Field of Classification Search

CPC ..... D06F 25/00; F06F 37/263; F06F 37/26; F06F 37/266; F06F 58/02; F06F 58/08

USPC ..... 34/449, 131, 86, 499, 601, 634, 242

See application file for complete search history.

(56) References Cited

U.S. PATENT DOCUMENTS

| | | | |
|---|---|---|---|
| 2,864,394 | A | 12/1958 | Hempel |
| 3,066,695 | A | 12/1962 | Allen |
| 3,807,444 | A | 4/1974 | Fortune |
| 3,875,686 | A | 4/1975 | Smoot |
| 4,669,200 | A | 6/1987 | Carr |
| 5,325,892 | A | 7/1994 | Japuntich et al. |
| 5,469,883 | A | 11/1995 | Lee |
| 5,601,117 | A | 2/1997 | Lewis et al. |
| 8,201,422 | B2 | 6/2012 | Lim et al. |
| 8,499,473 | B2 | 8/2013 | Dal Ben et al. |
| 8,516,716 | B2 | 8/2013 | Dal Ben et al. |
| 9,580,856 | B1 | 2/2017 | Schurr |
| 9,970,705 | B2 | 5/2018 | Lowe |

(Continued)

FOREIGN PATENT DOCUMENTS

| | | | |
|---|---|---|---|
| CN | 102373610 | A | 3/2012 |
| CN | 106283561 | A | 1/2017 |
| CN | 206570579 | U | 10/2017 |

(Continued)

OTHER PUBLICATIONS

English translation of JP 4541023 by PE2E Jun. 26, 2025.*

FBD Inflatable Silicone Gaskets, Sun Sil Polymers Pvt. Ltd., Dec. 22, 2020.

*Primary Examiner* — Deming Wan

(74) *Attorney, Agent, or Firm* — Brooks Kushman, P.C.

(57) ABSTRACT

A combination washer/dryer appliance is described that includes a tub mounted within an appliance housing and a drum rotatably supported within the tub. A seal assembly that closes an air gap between a rear drum wall and a rear tub wall is mounted to the drum. The seal assembly includes a resilient flap and a travel limiter, which limits the amount of deflection of the resilient flap, thereby defining a maximum deflection limit for the resilient flap.

13 Claims, 6 Drawing Sheets

(56) References Cited

U.S. PATENT DOCUMENTS 10,066,336 B2 9/2018 Schurr

FOREIGN PATENT DOCUMENTS

| | | | | | |
|---|---|---|---|---|---|
| DE | 3929023 | C1 | | 9/1990 | |
| DE | 19907602 | A1 | | 8/2000 | |
| DE | 102008043348 | A1 | | 5/2010 | |
| EP | 1790768 | A2 | | 5/2007 | |
| EP | 3173517 | A1 | | 5/2017 | |
| GB | 2297588 | A | | 8/1996 | |
| JP | 2004008683 | A | | 1/2004 | |
| JP | 2005304989 | A | | 11/2005 | |
| JP | 4541023 | B2 | * | 9/2010 | ..... D06F 25/00 |
| JP | 4945154 | B2 | | 6/2012 | |
| WO | 2007/148746 | A1 | | 12/2007 | |
| WO | 2014181496 | A1 | | 11/2014 | |
| WO | 2016/050295 | A1 | | 4/2016 | |
| WO | 2018171526 | A1 | | 9/2018 | |

* cited by examiner

AIR BYPASS SEAL WITH BACKER FOR IMPROVED DRYING PERFORMANCE IN A COMBINATION WASHER/DRYER

FIELD

The present disclosure relates generally to laundry appliances and more particularly to various sub-systems, sub-assemblies, and components of a front-load washer and dryer combination appliance.

BACKGROUND

This section provides background information related to the present disclosure which is not necessarily prior art.

Laundry appliances (i.e., laundry machines, washing machines, and dryers) are prolific in both residential and commercial settings. Traditionally, separate washer and dryer machines have been used in tandem to clean and dry laundry. However, there is a growing market for washer and dryer combination appliances where a single machine performs both the washing and drying functions, thereby eliminating the need for two separate machines. Different names have been used to describe washer and dryer combination appliances, including without limitation, "washer/dryer combos" and "all-in-one washer dryers." While these units save space compared to separate washer and dryer machines, combining the washing and drying functions into a single appliance presents certain challenges.

Many washer and dryer combination appliances have a front-load appliance configuration, where the washer and dryer combination appliance includes an appliance housing with a front opening that is accessed by a front-mounted appliance door. A cylindrical tub is mounted in the appliance housing. A cylindrical drum is positioned within, and rotatable with respect to, the tub. The drum typically has a front end with a drum opening that provides access to a laundry compartment inside the drum. An air gap exists between the walls (side and rear) of the drum and the walls (side and rear) of the tub.

A motor within the appliance housing is configured to rotate the drum at various speeds. In some instances, such as during the drying function, the drum is caused to rotate at relatively low speeds, such as about 55 rpm for example. The lower rotation speeds may facilitate the efficient movement of heated air through the laundry to dry it. In other instances, such as the spin cycle of the wash function (to remove excess water from the laundry before the drying function), the drum is caused to rotate at relatively higher rotation speeds, such as 500 rpm for example.

To maximize efficiency during the drying function, it is desirable to cause as much of the heated air as possible to enter the laundry chamber and prevent as much of the heated air as possible from passing around the outside of the drum in the air gap between the drum and the tub. Therefore, it has been known to incorporate a seal, such as a rubber baffle, between the drum and the tub, commonly attached to the drum and contacting the tub, to seal the air gap between the drum and the tub. However, when the tub is rotated at higher rotational rates, such as during the spin cycle of the washing function, and it is not critical that the air gap between the drum and the tub be sealed, physical contact of the seal to the tub creates unnecessary friction and wear. Therefore, it has been known that the seal may be configured such that it deflects under the centrifugal force generated during times that the drum is rotated at higher rotational speeds, thereby eliminating the physical contact between the seal and the tub, thereby opening the air gap between the drum and the tub.

The inventors hereof have developed a new sealing assembly to be used between the drum and the tub of an appliance that improves performance relative to known seals.

SUMMARY

This section provides a general summary of the disclosure and is not a comprehensive disclosure of its full scope or all its features.

A combination washer/dryer appliance is disclosed. The combination washer/dryer appliance includes a tub mounted within an appliance housing and including a rear tub wall. A drum is rotatably supported within the tub. The drum includes a cylindrical drum wall and a rear drum wall. A drying air inlet port is positioned in the rear tub wall. A seal assembly is mounted to the drum. The seal assembly is configured to be in contact with the rear tub wall when the drum is stationary or rotated at a relatively low speed, thereby closing the air gap between the rear drum wall and the rear tub wall. The seal assembly is configured to flex away from the rear tub wall in response to an increase in centrifugal force beyond a specified threshold as the speed of the drum rotation is increased. The seal assembly also includes a rigid travel limiter that limits the amount of deflection of the resilient flap, thereby defining a maximum deflection limit for the resilient flap.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and they are not intended to limit the scope of the present disclosure.

Corresponding reference numerals indicate corresponding parts throughout the several views of the drawings.

DETAILED DESCRIPTION

Figure 1:
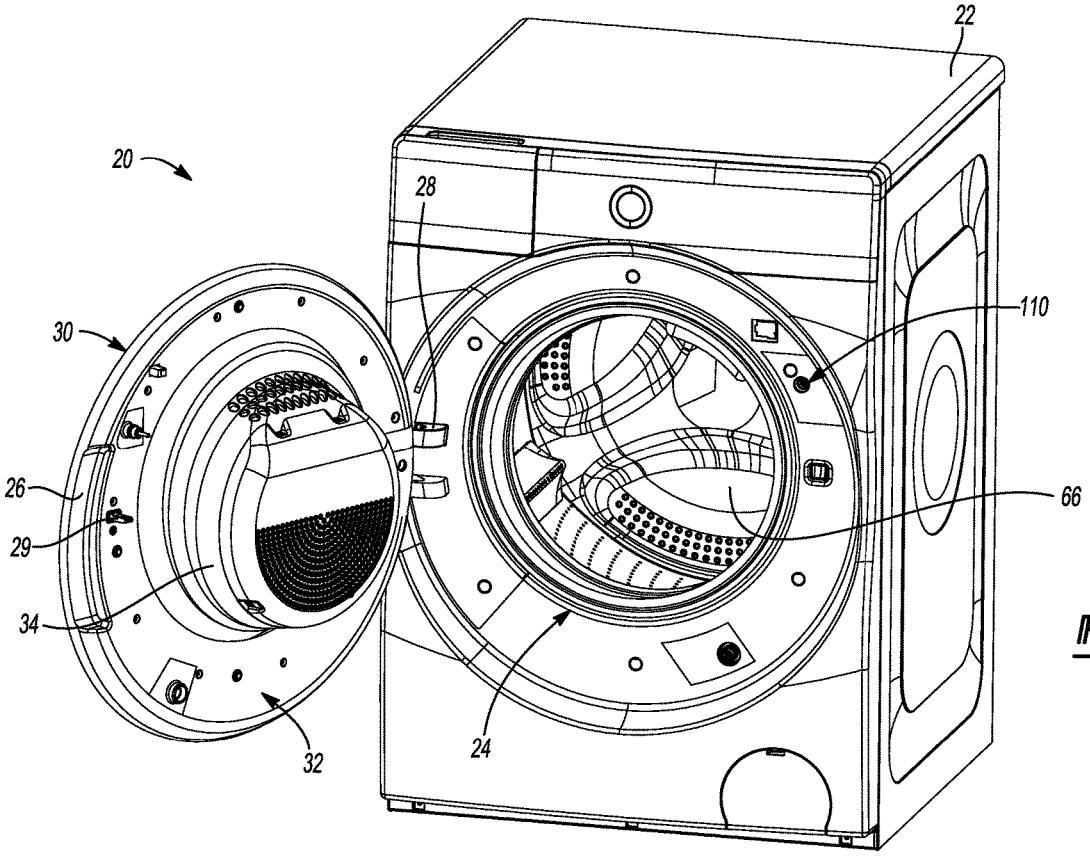
FIG. 1 illustrates a laundry appliance according to an exemplary embodiment.

Example embodiments will now be described more fully with reference to the accompanying drawings.

Example embodiments are provided so that this disclosure will be thorough and will fully convey the scope to those who are skilled in the art, Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

With reference to FIG. 1, a laundry appliance 20 having a front-load configuration is illustrated. The laundry appliance 20 includes an appliance housing 22 that is rectangular in shape and that includes a front opening 24. A front appliance door 26 is pivotally connected to the laundry appliance 20. The front appliance door 26 swings between an open position and a closed position. In the closed position, the front appliance door 26 shuts or closes the front opening 24 in the appliance housing 22. Although other configurations are possible, in the illustrated example, the front appliance door 26 is pivotally mounted to the front of the appliance housing 22 by a hinge 28 and held in the closed position during wash and drying functions by a latch 29.

The front appliance door 26 includes an outer door surface 30 that faces out away from the front opening 24 in the appliance housing 22 when the front appliance door 26 is in the closed position and an interior door surface 32 that faces the front opening 24 in the appliance housing 22 when the front appliance door 26 is in the closed position. The front appliance door 26 includes a bowl 34, which extends from the interior door surface 32 of the front appliance door 26. At least a portion of the bowl 34 is received in the front opening 24 in the appliance housing 22 when the front appliance door 26 is in the closed position. Among other functions, the bowl 34 prevents laundry inside the laundry appliance 20 from accumulating in the front opening 24 during tumbling and particularly during the wash cycle of the laundry appliance 20. Although other materials can be used, in the illustrated example, the front appliance door 26 is made of metal, while the bowl 34 is made of a molded plastic material.

Figure 2:
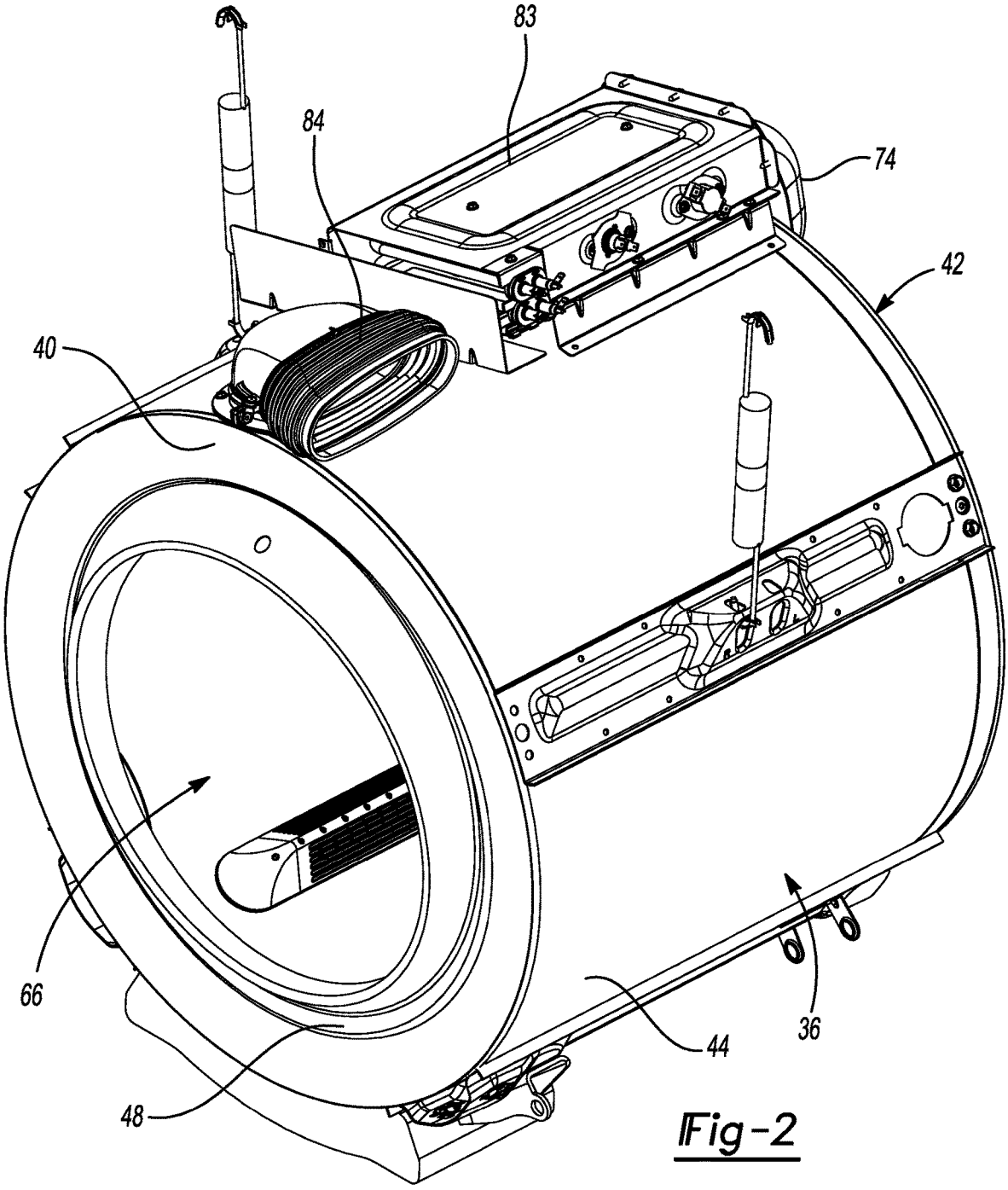
FIG. 2 is an isolated perspective view of an exemplary tub that may be mounted inside of the housing of the laundry appliance illustrated in FIG. 1.
Figure 3:
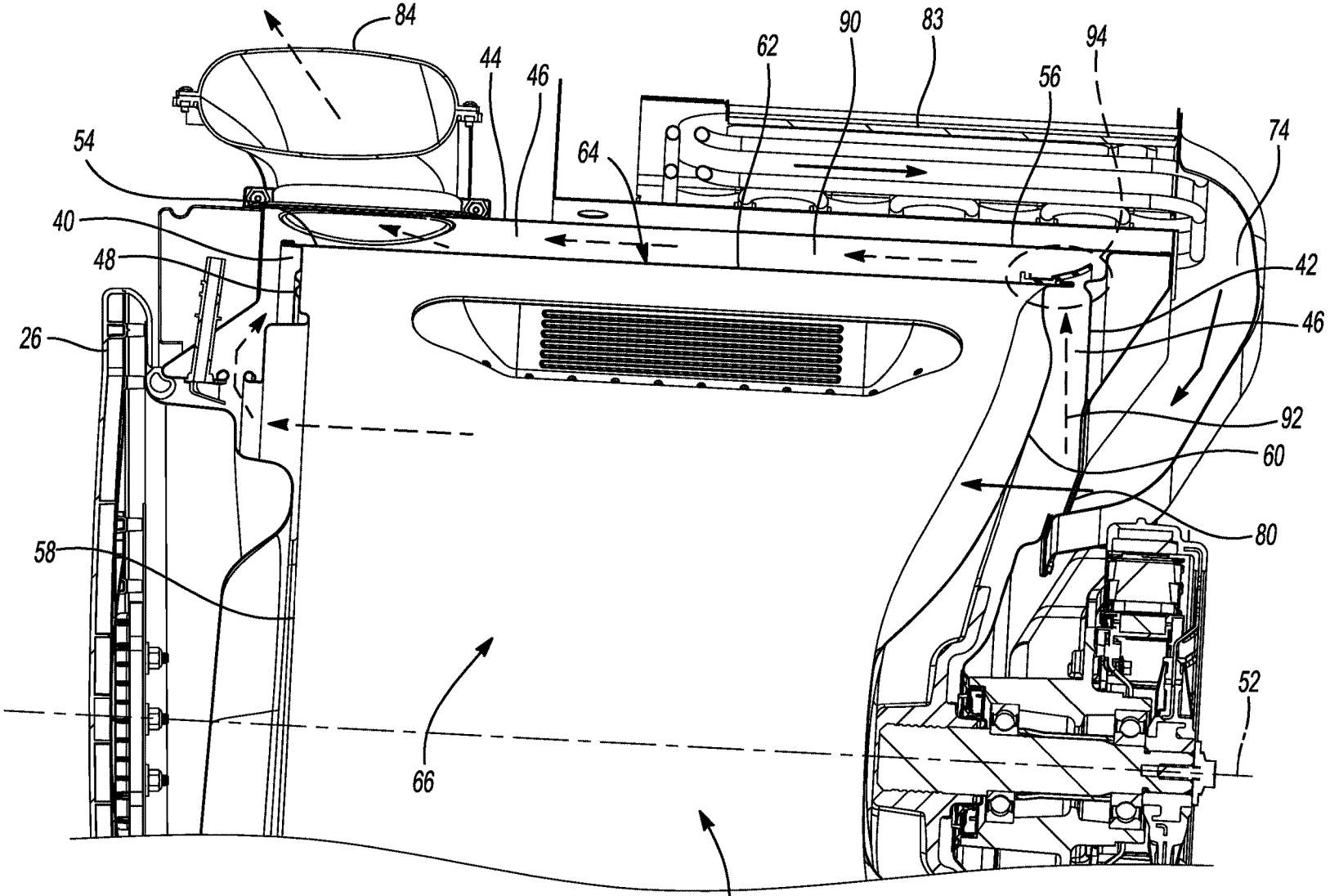
FIG. 3 is a side cut-away view of the tub illustrated in FIG. 2.

With reference to FIGS. 1, 2 and 3, the laundry appliance 20 includes a tub 36 with a cylindrical shape that is mounted inside the appliance housing 22. The tub 36 includes a front ring 40, a rear tub wall 42, and a tub sidewall 44 that extends longitudinally from the front ring 40 to the rear tub wall 42 to define a tub cavity 46 inside the tub 36. The front ring 40 of the tub 36 includes a tub opening 48 positioned in at least partial alignment with the front opening 24 in the appliance housing 22. The tub 36 includes a drying air outlet port 84, through which air from the laundry compartment can be expelled. A heater 83, which may be an electric resistance heater for example, may be mounted to the outside of the tub 36 for heating air that is provided to the laundry compartment 66 through drying air circulation duct 74 to dry laundry therein.

With reference to FIG. 3 (showing a cut-away side view of the upper portion of the tub 36 and drum 50), a drum 50 is positioned in the tub cavity 46 and is supported therein such that the drum 50 is rotatable with respect to the tub 36 about a longitudinal axis 52. The drum 50 also has a cylindrical shape and extends longitudinally between a front drum end 54 and a rear drum end 56. The drum 50 includes a drum opening 58 at the front drum end 54, a rear drum wall 60 at the rear drum end 56, and a drum sidewall 62 that extends longitudinally between the front and rear drum ends 54, 56. The drum sidewall 62 includes an outer surface 64 that faces the tub sidewall 44. The front drum end 54, the drum sidewall 62, and the rear drum wall 60 cooperate to define a laundry compartment 66 inside the drum 50. The front opening 24 in the appliance housing 22, the tub opening 48 in the front ring 40 of the tub 36, and the drum opening 58 at the front drum end 54 are at least partially aligned with one another and therefore provide access to the laundry compartment 66 inside the drum 50 when the front appliance door 26 is in the open position. To facilitate the rotation of the drum 50 within the tub 36, a small sidewall gap 90 exists between the drum sidewall 44 and tub sidewall 62. Similarly, a rear wall gap 92 exists between the rear drum wall 60 and the rear tub wall 42.

Figure 4:
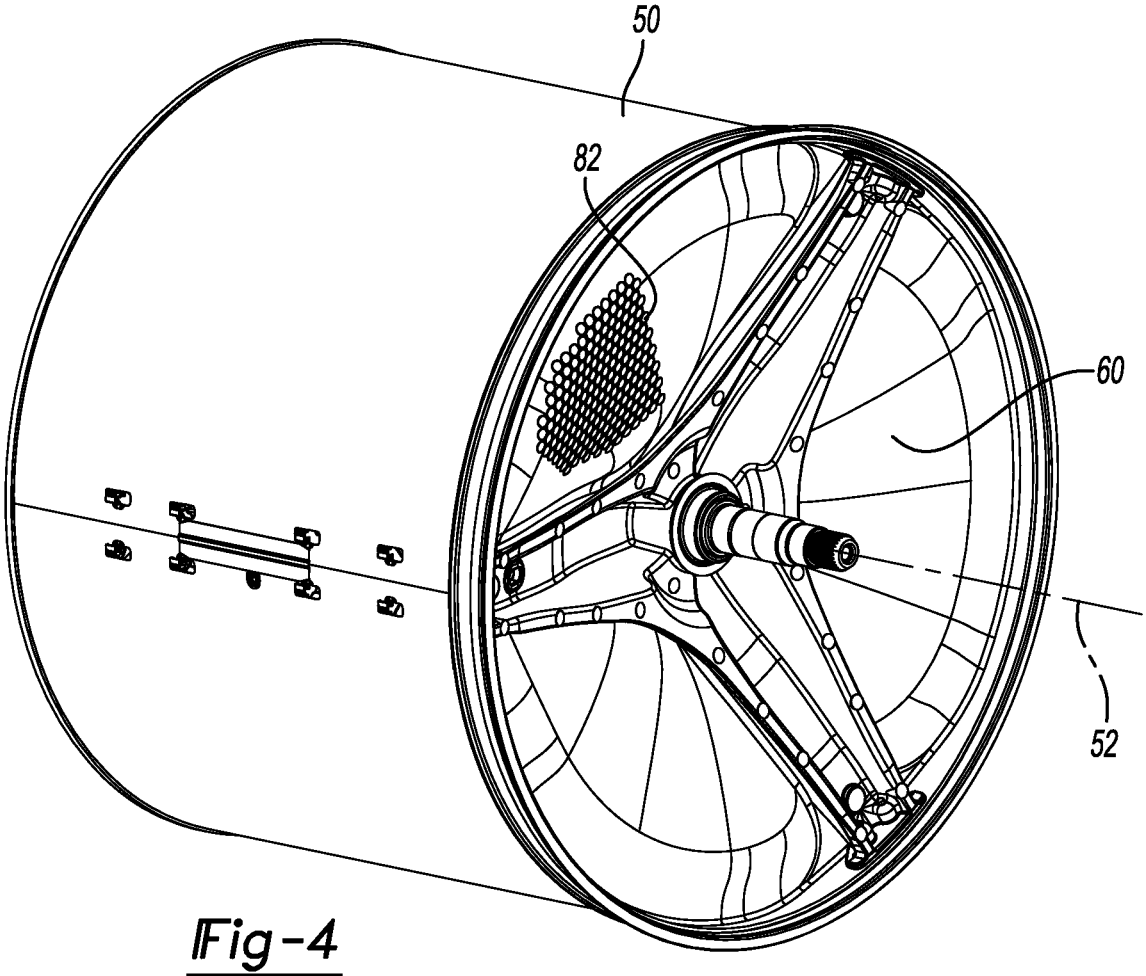
FIG. 4 is an isolated perspective view of an exemplary drum that may be mounted inside of the tub illustrated in FIGS. 2 and 3.

With additional reference to FIGS. 2, 3 and 4, the air circulation duct 74 fluidly connects the heater 83 to a drying air inlet port 80 positioned in the rear tub wall 42. During one or more portions of the drying function, the heater 83 operates to heat the air communicated to the drying air circulation duct 74 that ultimately passes through the drying air inlet port 80 in the rear tub wall 42 and into the laundry compartment 66 through drum rear cover holes 82 disposed on the rear drum wall 60. The heated air expelled into the laundry compartment 66 during a drying function of the laundry appliance 20 dries the laundry in the laundry compartment 66 as it tumbles within the rotating drum 50. The air cools as it passes through the laundry compartment 66, exiting the laundry compartment 66 and tub 36 through drying air outlet port 84.

During the drying function, the heated air is expelled through the drying air inlet port 80 in the rear tub wall 42, passes through the rear wall gap 92, and enters the laundry compartment 66 through drum rear cover holes 82 in the rear drum wall 60. Some amount of the heated air that passes through the drying air inlet port 80 in the rear tub wall 42 will not pass through the drum rear cover holes 82 into the laundry compartment 66, but instead will flow into the rear wall gap 92 between the rear drum wall 60 and the rear tub wall 42. It is preferable that as much of the heated air as possible enters the laundry compartment 66 and as little of the heated air as possible escapes into the sidewall gap 90 between the drum sidewall 44 and the tub sidewall 62 (which is fluidly connected to the rear wall gap 92). Therefore, a seal assembly 94 is disposed between the drum 50 and the tub 36 to seal the sidewall gap 90 from the rear wall gap 92.

Figure 5:
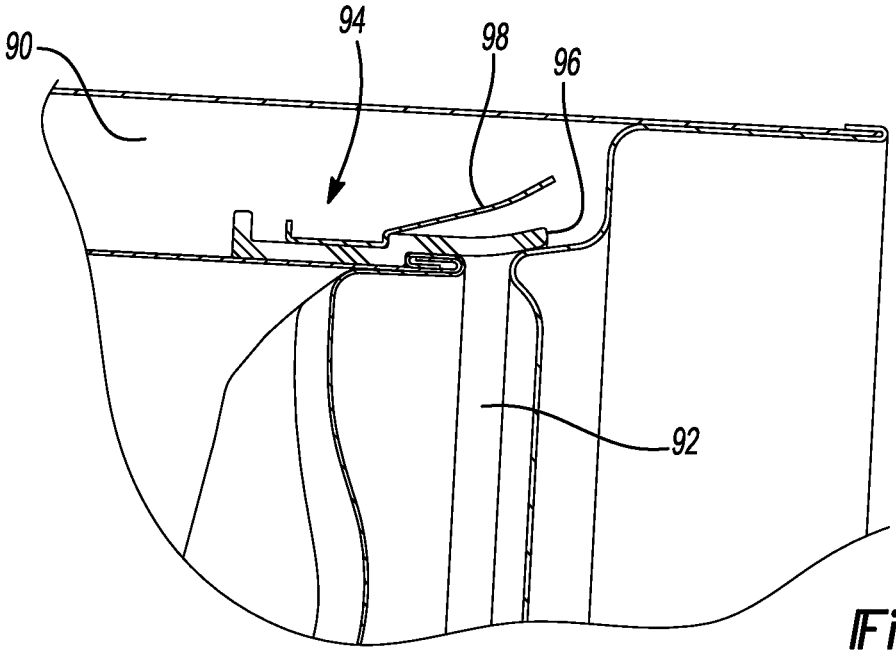
FIG. 5 is a close-up, side cut-away view of an exemplary seal assembly according to an embodiment.

With reference to FIG. 5, the seal assembly 94 includes a resilient flap 96 and a travel limiter 98. The resilient flap 96 may be mounted to the drum 50. The travel limiter 98 may also be mounted to the drum 50. The resilient flap 96 is made from a flexible material, such as for example rubber, such that the resilient flap 96 can provide a seal between the rear tub wall 42 and being deflected in response to a force. More specifically, the resilient flap 96 has a stiffness that permits the resilient flap 96 to dynamically adjust and close the air gap between the rear drum wall 60 and the rear tub wall 42. When the drum 50 is stationary or rotated at a relatively low speed (such as during the drying function), the resilient flap 96 is configured to be in contact with the rear tub wall 42 to maintain a seal and close the air gap between the rear drum wall 60 and rear tub wall 42. When the drum 50 is rotated at a relatively higher rate (such as during the spin cycle of the wash function), the resilient flap 96 is configured to flex away from the rear tub wall 42 in response to an increase in centrifugal force on the resilient flap beyond a certain threshold.

The travel limiter 98 is rigid and defines a maximum deflection limit for the resilient flap 96. When the resilient flap 96 deflects in response to an increase in centrifugal force, the travel limiter 98 provides a rigid surface that supports the resilient flap 96 and prevents the resilient flap 96 from deflecting beyond the travel limiter 98. The travel limiter 98 may be made of many different types of materials, including metal, provided the material provides adequate rigidity to provide the described support and deflection-limiting functions described herein. The seal assembly 94, and its components, can be mounted to the drum 50 in a variety of ways known to a person skilled in the art.

Figure 6A:
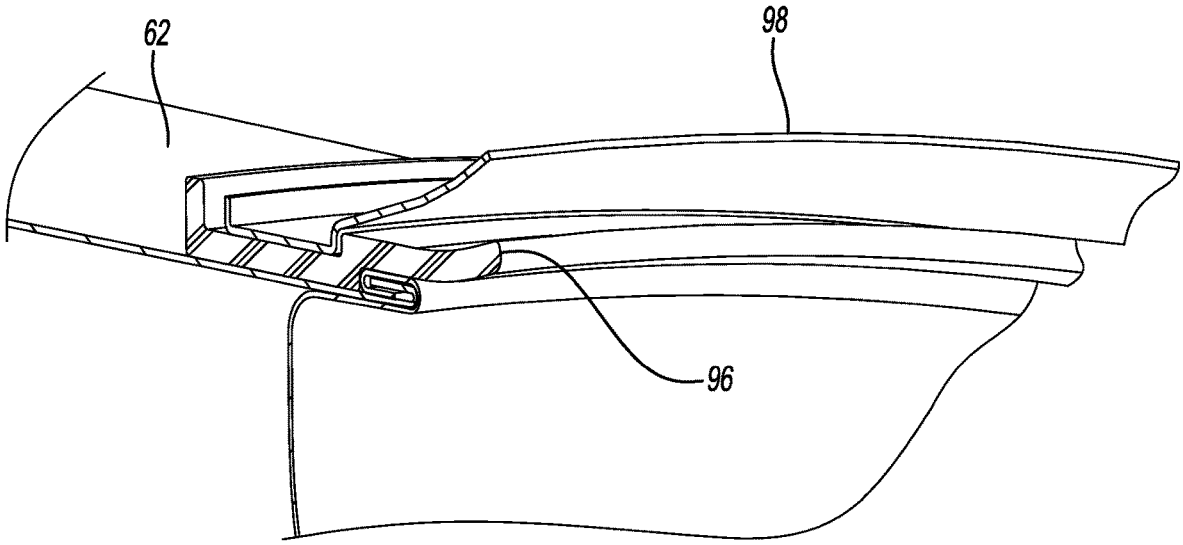
FIG. 6A is an isolated perspective view of a portion of the seal assembly illustrated in FIG. 5, shown with the resilient flap in a non-biased, non-deflected position.
Figure 6B:
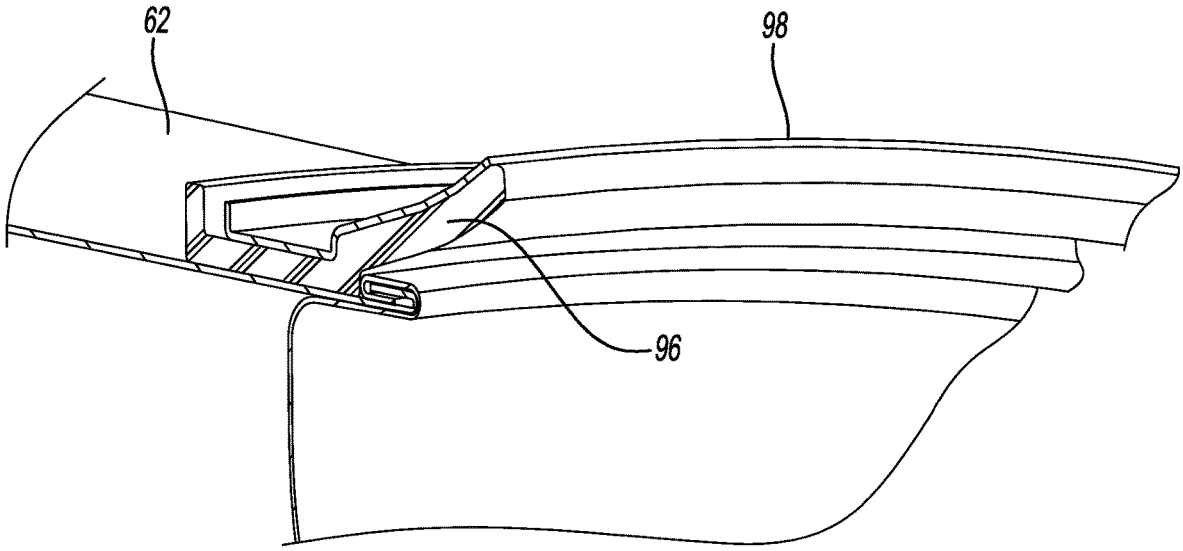
FIG. 6B is an isolated perspective view of a portion of the seal assembly, as illustrated in FIG. 6A, but showing the exemplary resilient flap in a deflected position such that the amount of deflection is limited by an exemplary travel limiter.

FIGS. 6A and 6B show the seal assembly 94 of FIG. 5, including resilient flap 96 and travel limiter 98, in a partial perspective view. As illustrated, the seal assembly 94 may be generally circular and disposed around the periphery of the drum 50 and attached to the drum side wall 62 at the rear drum end 56. The resilient flap 96 may have an approximately planar surface. In FIG. 6A, the resilient flap 96 is shown in an unbiased, closed position, such that there is space between the resilient flap 96 and the travel limiter 98. In this position the resilient flap is not deflected and would be pressed against the rear tub wall 42 to seal the air gap between the tub 36 and the drum 50. This would be the position of the resilient flap 96 when the drum is rotated at relatively low rotational speeds, such as during the drying function. In FIG. 6B, the resilient flap 96 is shown in a deflected position, pressed against an approximately planar surface of the travel limiter 98. The deflection would be caused by centrifugal force caused by rotation of the drum 50 at relatively higher speeds, such as during the spin cycle of the washing function. The deflection of resilient flap 96 is limited by travel limiter 98.

Figure 7A:
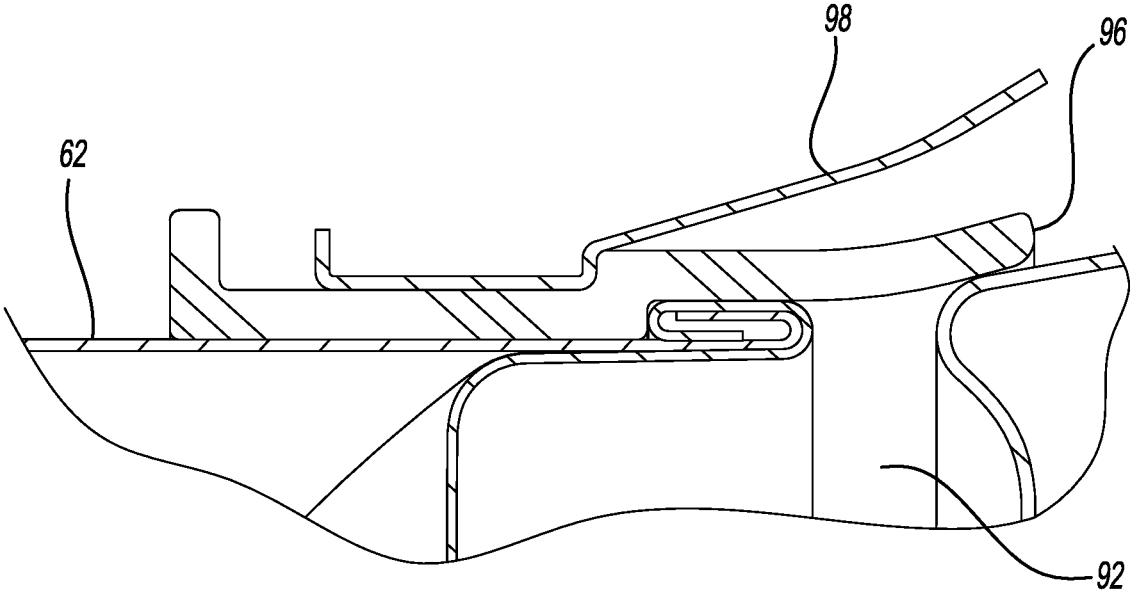
FIG. 7A is a side cut-away view of the exemplary seal assembly illustrated in FIG. 6A, shown with the resilient flap in a non-biased, non-deflected position.
Figure 7B:
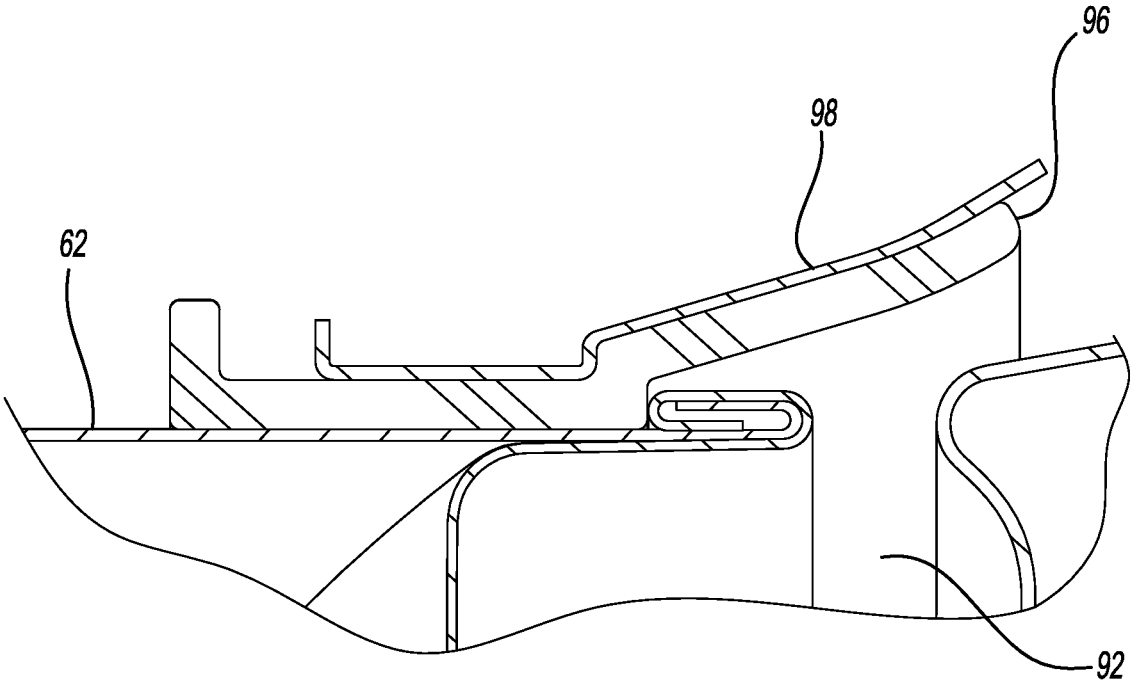
FIG. 7B is a side cut-away view of the exemplary seal assembly illustrated in FIG. 7A but showing the resilient flap in a deflected position such that the amount of deflection is limited by an exemplary travel limiter.

FIGS. 7A and 7B are isolated, cross-sectional views of the seal assembly 94 shown in FIGS. 3, 5 and 6. FIG. 7A shows the resilient flap 96 in the closed position, sealing the air gap 92, such as during relatively low rotational speeds of the drum 50. FIG. 7B shows the resilient flap 96 in an open position, deflected by centrifugal force created by relatively higher rotational speeds of the drum. The amount of deflection is limited by travel limiter 98.

The travel limiter 98 provides several benefits. The travel limiter 98 provides support to the resilient flap 96 to limit the amount of deflection during relatively higher rotational speeds of the drum (e.g., during the spin cycle of the wash function). Consequently, the amount of strain and permanent set of the resilient flap 96 is limited by the travel limiter 98, which improves the durability and longevity of the resilient flap 96. With improved durability and longevity performance, the resilient flap 96 may be made from a material having a lesser stiffness than would otherwise be required to meet a desired durability and longevity specification. Such a resilient flap 96 made from a material having a relatively less degree of stiffness can be made to deflect to eliminate contact of the resilient flap 96 to the tub 36 at lower rotational speeds (rpms) than would otherwise be possible without the travel limiter 98. As a result, the undesirable consequences of friction between the resilient flap 96 and the tub 36 during non-drying functions (i.e., when the sealing function is not needed) can be reduced overall by eliminating such consequences at lower rotational speeds.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A combination washer/dryer appliance, comprising:

a tub mounted within an appliance housing, the tub including a rear tub wall;

a drum rotatably supported within the tub, the drum including a cylindrical drum wall and a rear drum wall;

a seal assembly mounted to the drum;

the seal assembly including a resilient flap with a stiffness that permits the resilient flap to close an air gap between the rear drum wall and the rear tub wall during low-speed rotation of the drum and to flex away from the rear tub wall in response to an increase in centrifugal force on the resilient flap during rotation of the drum at a higher speed; and the seal assembly including a generally rigid travel limiter that limits the amount of deflection of the resilient flap, thereby defining a maximum deflection limit for the resilient flap, wherein the resilient flap has a degree of stiffness that would permit an amount of deflection in response to increased centrifugal force greater than the amount of deflection permitted by said travel limiter.

2. The combination washer/dryer appliance of claim 1, wherein the travel limiter is mounted to the drum.

3. The combination washer/dryer appliance of claim 2, wherein the travel limiter comprises a metal.

4. The combination washer/dryer appliance of claim 1, wherein the travel limiter is at least approximately circular.

5. The combination washer/dryer appliance of claim 4, wherein the travel limiter includes an approximately planar surface against which an approximately planar surface of the resilient flap is configured to rest against.

6. The combination washer/dryer appliance of claim 1, further comprising a drying air inlet port in the rear drum wall.

7. A combination washer/dryer appliance, comprising:

a tub mounted within an appliance housing, the tub including a rear tub wall;

a drum rotatably supported within the tub, the drum including a cylindrical drum wall and a rear drum wall;

a seal assembly mounted to the drum;

the seal assembly including a resilient flap with a stiffness that permits the resilient flap to close an air gap between the rear drum wall and the rear tub wall during low-speed rotation of the drum and to flex away from the rear tub wall in response to an increase in centrifugal force on the resilient flap during rotation of the drum at a higher speed; and the seal assembly including a means for limiting the deflection of the resilient flap to a lesser maximum deflection than would be permitted by the inherent stiffness characteristics of the resilient flap alone.

8. The combination washer/dryer appliance of claim 7, wherein the means for limiting the deflection of the resilient flap is mounted to the drum.

9. The combination washer/dryer appliance of claim 7, wherein the means for limiting the deflection of the resilient flap comprises a rigid material.

10. The combination washer/dryer appliance of claim 7, wherein the means for limiting the deflection of the resilient flap is generally circular.

11. The combination washer/dryer appliance of claim 10, wherein the means for limiting the deflection of the resilient flap includes an approximately planar surface against which an approximately planar surface of the resilient flap is configured to rest against.

12. The combination washer/dryer appliance of claim 7, further comprising a drying air inlet port in the rear drum wall.

13. A combination washer/dryer appliance, comprising:

a tub mounted within an appliance housing, the tub including a rear tub wall;

a drum rotatably supported within the tub, the drum including a cylindrical drum wall and a rear drum wall;

a drying air inlet port in the rear drum wall;

a seal assembly mounted to the drum;

the seal assembly including a resilient flap with a stiffness that permits the resilient flap to close an air gap between the rear drum wall and the rear tub wall during low-speed rotation of the drum and to flex away from the rear tub wall in response to an increase in centrifugal force on the resilient flap during rotation of the drum at a higher speed; and the seal assembly including a generally rigid travel limiter mounted to the drum that limits the amount of deflection of the resilient flap, thereby defining a maximum deflection limit for the resilient flap, wherein the rigid travel limiter is at least approximately circular and includes an approximately planar surface against which an approximately planar surface of the resilient flap is configured to rest against.

* * * * *